US008113164B2

(12) United States Patent
Warren et al.

(10) Patent No.: US 8,113,164 B2
(45) Date of Patent: Feb. 14, 2012

(54) IGNITION SOURCE ADAPTED FOR POSITIONING WITHIN A COMBUSTION CHAMBER

(76) Inventors: James C. Warren, Fairfax, VA (US); Dennis K. Scheer, Birmingham, MI (US)

( * ) Notice: Subject to any disclaimer, the term of this patent is extended or adjusted under 35 U.S.C. 154(b) by 132 days.

(21) Appl. No.: 12/288,872

(22) Filed: Oct. 24, 2008

(65) Prior Publication Data

US 2009/0133656 A1 May 28, 2009

Related U.S. Application Data

(63) Continuation-in-part of application No. 11/589,118, filed on Oct. 30, 2006, now Pat. No. 7,448,352.

(60) Provisional application No. 60/731,266, filed on Oct. 31, 2005.

(51) Int. Cl.
*F02P 1/00* (2006.01)

(52) U.S. Cl. ..... 123/146.5 R; 123/169 R

(58) Field of Classification Search ..... 123/146.5 R, 123/169 R, 169 EA, 169 PA
See application file for complete search history.

(56) References Cited

U.S. PATENT DOCUMENTS

| | | | | |
|---|---|---|---|---|
| 4,841,925 | A * | 6/1989 | Ward | 123/143 B |
| 6,095,124 | A * | 8/2000 | Matsubara et al. | 123/594 |
| 6,244,247 | B1 * | 6/2001 | Matsubara et al. | 123/305 |
| 7,448,352 | B2 * | 11/2008 | Warren | 123/161 |
| 2009/0126669 | A1 * | 5/2009 | Warren | 123/146.5 R |

* cited by examiner

*Primary Examiner* — John Kwon
(74) *Attorney, Agent, or Firm* — L.C. Begin & Associates, PLLC

(57) ABSTRACT

An ignition source for initiating combustion is provided. The ignition source includes an electrical delivery conductor mounted in a delivery conductor mounting structure. An electrical ground conductor is mounted in a ground conductor mounting structure and extends from the ground conductor mounting structure to a point proximate the delivery conductor to define an ignition spark gap between the delivery conductor and the ground conductor. At least one of the delivery conductor and the ground conductor are mounted in a respective one of the delivery conductor mounting structure and the ground conductor mounting structure so as to be selectively positionable with respect to the other one of the delivery conductor and the ground conductor to selectively adjust a width of the ignition spark gap.

2 Claims, 3 Drawing Sheets

IGNITION SOURCE ADAPTED FOR POSITIONING WITHIN A COMBUSTION CHAMBER

CROSS-REFERENCE TO RELATED APPLICATIONS

This application is a continuation-in-part of U.S. application Ser. No. 11/589,118, filed on Oct. 30, 2006 now U.S. Pat. No. 7,448,352, which claims the benefit of U.S. Provisional Application No. 60/731,266 filed on Oct. 31, 2005.

BACKGROUND OF THE INVENTION

The present invention relates generally to spark ignition systems for use in combustion devices, e.g., reciprocating engines, furnaces, etc., and more particularly, to an ignition source having one or more elements adapted for adjustable positioning within the combustion device.

SUMMARY OF THE INVENTION

In one aspect of embodiments of the present invention, an ignition source for initiating combustion is provided. The ignition source includes an electrical delivery conductor mounted in a delivery conductor mounting structure. An electrical ground conductor is mounted in a ground conductor mounting structure and extends from the ground conductor mounting structure to a point proximate the delivery conductor to define an ignition spark gap between the delivery conductor and the ground conductor. At least one of the delivery conductor and the ground conductor are mounted in a respective one of the delivery conductor mounting structure and the ground conductor mounting structure so as to be selectively positionable with respect to the other one of the delivery conductor and the ground conductor to selectively adjust a width of the ignition spark gap.

DETAILED DESCRIPTION

Figure 1:
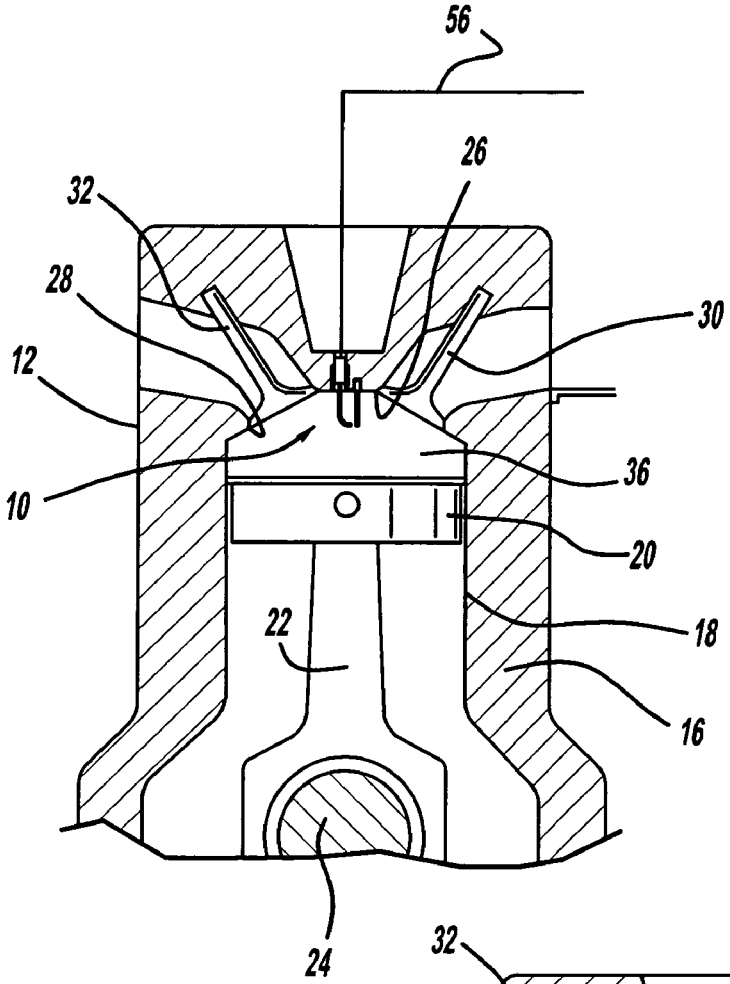
FIG. 1 is a schematic view of an internal combustion engine incorporating an ignition source in accordance with an embodiment of the present invention.

FIG. 1 shows a portion of an internal combustion engine 12 including an ignition source, generally designated 10, positioned within a combustion chamber 36, in accordance with embodiments of the present invention. Various embodiments of a mechanism for providing an ignition spark to the interior of the combustion chamber are described herein.

As shown in FIG. 1, the engine 12 has a cylinder head 14, plurality of cylinder chambers 18 (one shown) defined in an engine body or cylinder block 16, and a plurality of pistons 20

(one shown) axially displaceably disposed in the cylinder chamber 18. When the piston 20 is displaced in its stroke, it changes the effective volume of the combustion chamber 36 to cause the engine 12 to operate in intake, compression, power, and exhaust strokes, in a manner known in the art. The displacement of the piston 20 is output as drive power from the engine 12, from the piston 20 through a connecting rod 22 and a crankshaft 24.

The engine body 16 has an intake port 26 and an exhaust port 28 defined therein, which open into each of the cylinder chambers 18. An intake valve 30 is operatively disposed in the intake port 26, and an exhaust valve 32 is operatively disposed in the exhaust port 28.

Embodiments of the ignition source described herein include conductors 38, 46 (described in greater detail below) mounted to a wall of the cylinder, to cylinder head 14, to the cylinder block or engine body 16, or to another mounting structure suitable for mounting of the ignition source components described herein.

As used herein, the term "mounting structure" is understood to mean any portion of the device into which ignition source 10 is incorporated that is suitable for mounting of either of delivery conductor 38 or ground conductor 46 therein, so as to enable the ignition source to perform the functions described herein. For example, in the embodiment shown in FIGS. 1 and 3, conductors 38, 46 are mounted in cylinder head 14 and extend into a combustion chamber 36 defined by the cylinder head 14, the cylinder wall(s), and the piston 20. In the embodiment shown in FIGS. 2 and 4, conductors 38 and 46 are mounted in the cylinder block 16 and extend across at least a portion of the width or diameter of the cylinder. The delivery conductor mounting structure and the ground conductor mounting structure may comprise the same element of the device into which the ignition source is incorporated. For example, in FIG. 1, both of the delivery and ground conductors are mounted in the cylinder head. Alternatively, each of the conductors 38 and 46 could be mounted in different elements of the device (i.e., the delivery conductor could be mounted in the cylinder head, while the ground conductor is mounted in the cylinder wall). Thus, the mounting of the conductors can be adjusted to meet the requirements of a particular device geometry or functional application.

The engine block 12, cylinder head 14, cylinders 18, and other engine components may each be formed conventionally, e.g., cast as a single, monolithic unit, or manufactured as separate components and mechanically assembled together, as desired.

Figure 3:
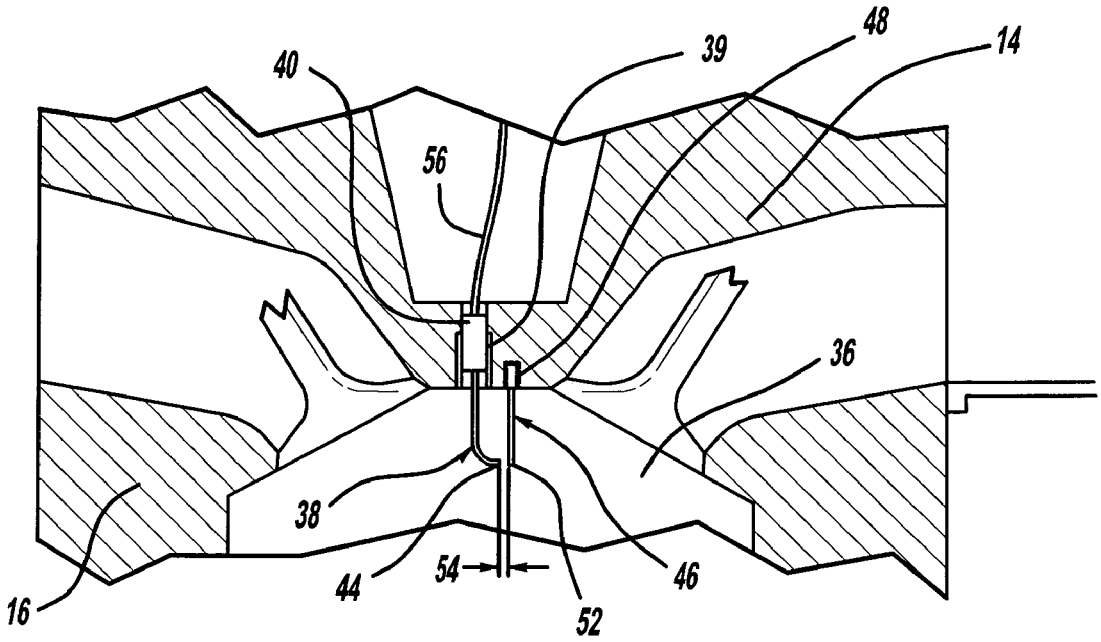
FIG. 3 is a partial cross-sectional view of an ignition source in accordance with the embodiment of FIG. 1 extending into a combustion chamber of an engine.

FIGS. 1 and 3 illustrate ignition source 10 extending into a combustion chamber 36 formed within cylinder 18 of the engine, in accordance with one embodiment of the present invention. In this embodiment, the ignition source includes a two-piece spark rod having an electrical delivery conductor 38 with a base end 40 that is secured to a wall of a cylinder, a portion of a cylinder head, or any other structure suitable for mounting the conductor therein. While the conductor 38 is mounted to the cylinder wall or other mounting structure, the conductor may be electrically insulated from the wall and the structure in which the conductor is mounted, to prevent premature grounding. A known insulating material (for example, a polymer or ceramic material) 39 may be positioned between conductor 38 and the structure in which the conductor is mounted.

The conductor 38 extends from the cylinder head 14 into the combustion chamber 36, and terminates in an electrode end 44. In a particular embodiment, the electrode end 44 is positioned within the generally central area or volume of the combustion chamber 36 as defined by the cylinder wall, cylinder head, and piston at approximately the moment at which ignition of the fuel/air mixture is designed to occur. In other embodiments, conductor 38 is configured so that electrode end 44 resides at a desired position which is spaced apart from the theoretical center of the combustion chamber 36, according to the needs of a particular application. Accordingly, conductor 38 may be straight, curved (as shown in FIG. 3), or may include any combination of straight or curved portions or have any shape necessary for positioning electrode end 44 in the desired position within the combustion chamber.

Referring again to FIGS. 1 and 3, a second spark rod component comprises an electrical ground conductor 46 having an electrically grounded end 48 which is mechanically and electrically connected to a wall of the cylinder, a portion of the cylinder head 14, or to any other structure suitable for mounting the ground conductor therein. The structure in which ground conductor 46 is mounted may be the same structure or a different structure from that in which delivery conductor 38 is mounted.

Grounded end 48 may be secured to any desired portion of the mounting structure, either proximate (and suitably electrically isolated from) delivery conductor 38 (as shown in FIG. 3), or spaced apart from the delivery conductor. The ground conductor 46 further includes an electrode end 52 extending into the combustion chamber 36 adjacent the electrode end 44 of the delivery conductor 38. Accordingly, ground conductor 46 may be straight (as shown in FIG. 3), curved, or may include any combination of straight or curved portions or have any shape necessary for positioning electrode end 52 in the desired position adjacent electrode end 44 within the combustion chamber.

The respective electrode ends 44 and 52 of the two conductors 38 and 46 define an ignition spark gap 54 therebetween, with a spark jumping the gap 54 when sufficient electrical potential is applied to the delivery conductor 38. In an embodiment where electrode end 44 (and, therefore, spark gap 54) is positioned at or proximate the theoretical center of the combustion chamber volume, substantially optimum ignition of the fuel/air mixture within the combustion chamber may be facilitated, with the combustion propagation spreading essentially uniformly in all directions from such a centrally located ignition source.

In the embodiments shown herein, the dimension of the spark gap 54 may be adjusted by providing a threaded base end for one or more of the two conductors, inserting the base end of the conductor into its associated mounting structure, and threading it inwardly or outwardly in its attachment to the mounting structure. For example, delivery conductor 38 could be mounted in a threaded sleeve 39 (FIG. 3) formed from a non-conductive material or otherwise insulated from the device in which the conductor is mounted. This sleeve 39 would also provide a conduit enabling electrical connection of the delivery conductor 38 to the voltage supply line (described below). Ground conductor 46 could be mounted in a threaded hole (as shown in FIG. 3) formed in an element of the device that is electrically connected to ground. Other modes of controlling the positioning of the conductors are also contemplated.

FIGS. 1-5 illustrate various embodiments of the present ignition source. In all cases the spark gap 54 is located a sufficient distance from the peripheral wall of combustion chamber 36 to prevent premature grounding of delivery conductor 36.

An electrical supply line 56 extends through the cylinder wall, cylinder head 14, or other mounting structure into which delivery conductor 38 is mounted. Supply line 56 electrically communicates with delivery conductor 38. A controller 50 is coupled to a voltage source (not shown) and/or to the supply line for regulating application of a voltage to delivery conductor 38. Supply line 56 provides electrical power to the delivery conductor 38 responsive to a command from the controller.

The controller may be set or programmed to periodically activate the voltage source, to permit periodic electrical communication between the voltage source and the delivery conductor, or otherwise to regulate application of a voltage to delivery conductor 38 so as to generate a spark at spark gap 54, in a manner timed to substantially coincide with maximum compression of the fuel/air mixture during the engine cycle (for example, when the piston is at or near top dead center). In other applications (for example, in a furnace) (not shown), application of the voltage to the delivery conductor may be regulated based on feedback received from a thermostat or other control device, in a manner known in the art. The controller 50 may be a micro-processor based controller or any other controller suitable for regulating the timing of voltage application to the delivery conductor in accordance with the requirements of the desired engine cycle.

While electrical insulation along the entire lengths of the delivery and ground conductors 38 and 46 is generally not required due to the spacing between the delivery conductor 38 and any electrically grounding structure, such insulation can provide additional physical or mechanical strengthening for the ignition rod assembly comprising the two conductors 38 and 46.

Figure 2:
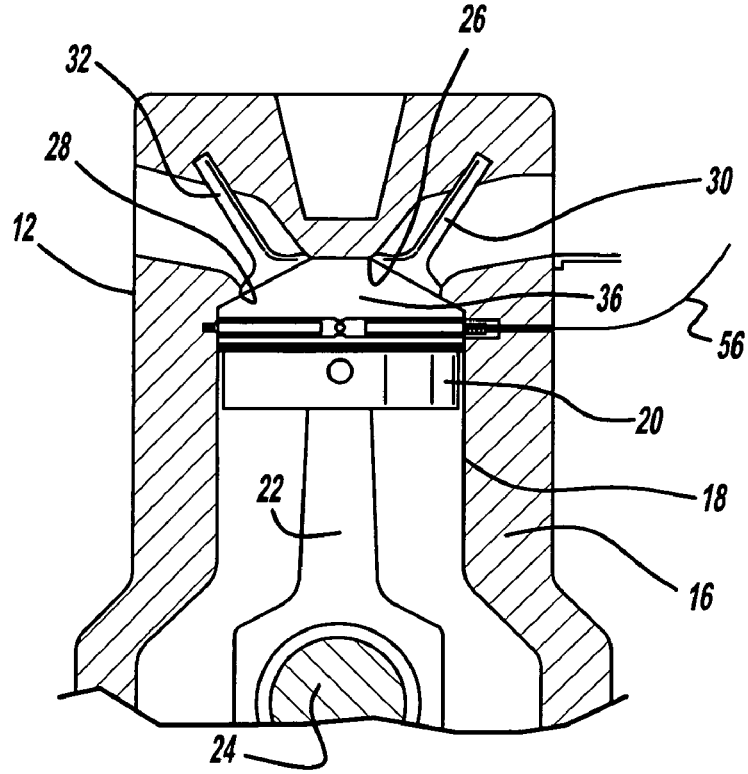
FIG. 2 is a schematic view of an internal combustion engine incorporating an ignition source in accordance with another embodiment of the present invention.
Figure 4:
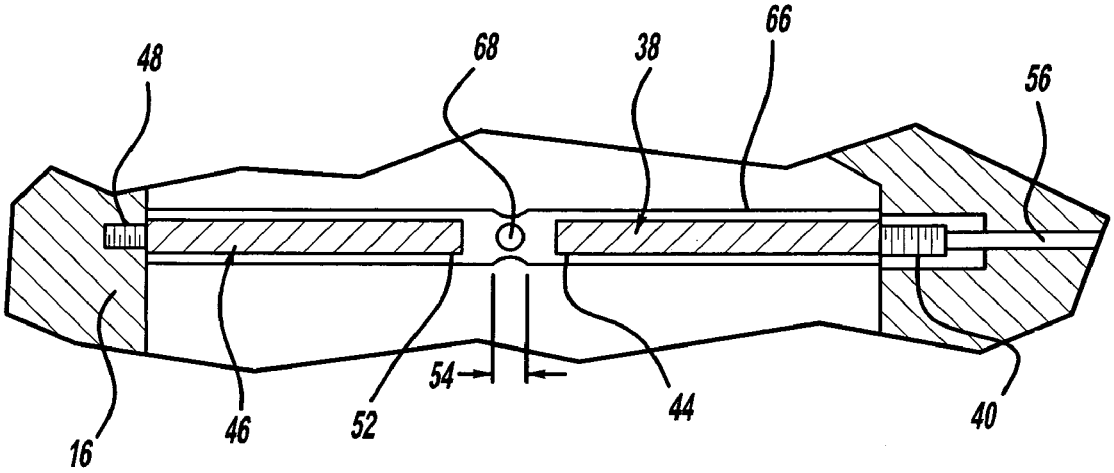
FIG. 4 is a partial cross-sectional view of an ignition source in accordance with the embodiment of FIG. 2 extending into a combustion chamber of an engine.
Figure 5:
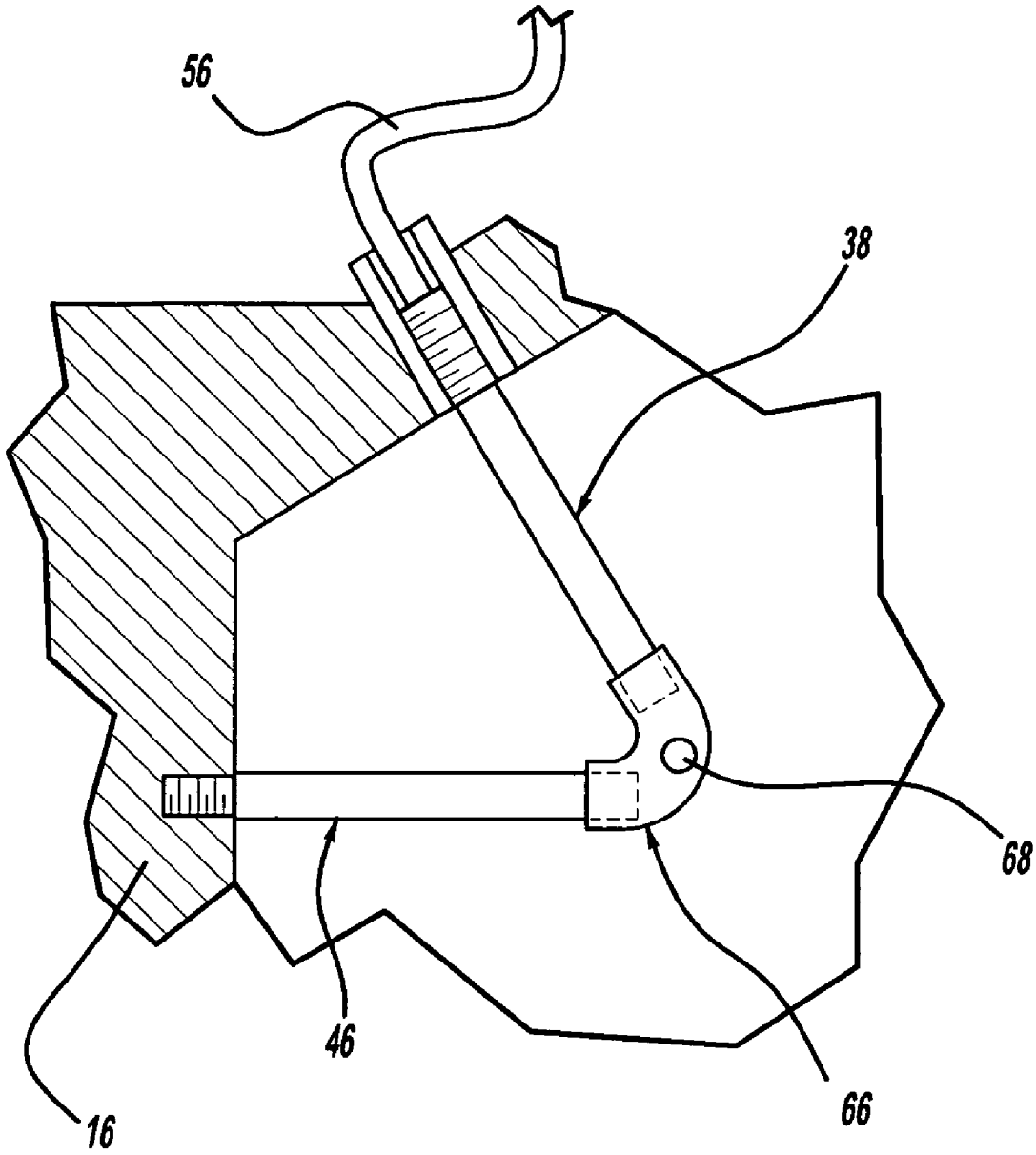
FIG. 5 is a partial cross-sectional view of an ignition source in accordance with yet another embodiment of the present invention extending into a combustion chamber of an engine.

Referring to FIGS. 2 and 4, in one embodiment, an electrical insulator is in the form of a continuous tube 66 surrounding the two conductors 38 and 46. Tube 66 may be formed from any suitable insulating material (for example, a polymer or ceramic material) or combination of materials, and may be either relatively rigid or relatively flexible, according to the requirements of a particular application. In the embodiment shown in FIGS. 2 and 4, the insulator tube 66 includes at least one spark exposure aperture or passage 68 adjacent the spark gap 54, to allow the air/fuel mixture to circulate and flow therethrough in the vicinity of the spark gap 54 in order for an ignition spark to ignite the air/fuel mixture when the spark occurs. In an alternative embodiment (not shown), a series of spark exposure passages 68 are formed along tube 66 in the vicinity of spark gap 54.

In one embodiment, tube 66 is relatively rigid and provides additional physical or mechanical strengthening for the ignition rod assembly. In another particular embodiment (shown in FIG. 5), tube 66 is formed from a relatively flexible or malleable material) or combination of materials) which permits the configuration of the spark rod assembly to be adjusted according to the needs of a particular application, while maintaining the desired spatial relationship between the electrode ends of conductors 38 and 46.

In another particular embodiment (shown in FIG. 5), the insulation tube covers only a portion of each of conductors 38 and 46, or only the electrode ends of each of conductors 38 and 46. Thus, the insulator serves to maintain the spatial relationship between the electrode ends of conductors 38 and 46 and includes openings 68 providing fluid communication between spark gap 54 and the fuel/air mixture in the combustion chamber.

The range of electrode configurations described herein provides the ability to position the spark gap 54 at essentially any desired point within the combustion chamber. This flexibility in positioning of the spark gap enables optimization of the combustion reaction to be facilitated within a wide variety of combustion chamber shapes and sizes, by facilitating positioning of the spark gap at or near the theoretical center of the combustion chamber or at any other desired location within the combustion chamber, for any given combustion chamber configuration. In addition, the electrodes may be configured as needed so as lie within the combustion chamber, yet outside the path of motion of a piston mounted in the chamber. Thus, the benefits of positioning the spark source within the combustion chamber are retained.

It should be noted that although the embodiments disclosed herein are described as they may be applied to an internal combustion engine, embodiments of the present invention may be applied to other devices than engines, such as furnace combustors and the like.

It will be understood that the foregoing description of the present invention is for illustrative purposes only, and that the various structural and operational features herein disclosed are susceptible to a number of modifications, none of which departs from the spirit and scope of the present invention. The preceding description, therefore, is not meant to limit the scope of the invention. Rather, the scope of the invention is to be determined only by the appended claims and their equivalents.

What is claimed is:

1. An ignition source for initiating combustion, comprising:

an electrical delivery conductor having an end portion;

an electrical ground conductor having an end portion residing adjacent the delivery conductor end portion so as to define a spark gap between the adjacent end portions; and an insulating member covering only the ground conductor and delivery conductor end portions, to maintain a spacing between the end portions.

2. The ignition source of claim 1 wherein the ground conductor extends along a first axis and the delivery conductor extends along a second axis, and wherein the ground conductor and the delivery conductor are oriented such that an intersection of the first axis and the second axis defines an angle of less than 180 degrees.

* * * * *